US011198542B2

(12) United States Patent
Wang

(10) Patent No.: US 11,198,542 B2
(45) Date of Patent: Dec. 14, 2021

(54) ILLUMINATED BOTTLE STOPPER

(71) Applicant: Hua-Cheng Pan, Tainan (TW)

(72) Inventor: Chih-Liang Wang, Tainan (TW)

(73) Assignee: Hua-Cheng Pan, Tainan (TW)

( * ) Notice: Subject to any disclaimer, the term of this patent is extended or adjusted under 35 U.S.C. 154(b) by 204 days.

(21) Appl. No.: 16/666,413

(22) Filed: Oct. 29, 2019

(65) Prior Publication Data

US 2021/0122531 A1 Apr. 29, 2021

(51) Int. Cl.

| | |
|---|---|
| ***B65D 39/00*** | (2006.01) |
| ***B65D 51/24*** | (2006.01) |
| *F21Y 115/10* | (2016.01) |
| *F21V 33/00* | (2006.01) |

(52) U.S. Cl.

CPC ..... *B65D 39/0052* (2013.01); *B65D 51/248* (2013.01); *F21V 33/0036* (2013.01); *F21Y 2115/10* (2016.08)

(58) Field of Classification Search

CPC ..... B65D 33/16; B65D 2539/001; B65D 47/141; B65D 47/121; B65D 41/60; B65D 41/58; B65D 41/30; B65D 41/28; B65D 39/0094; B65D 39/0082; B65D 39/0047; B65D 39/0035; B65D 39/0052; B65D 51/248; F21Y 2115/10; F21V 33/0036

See application file for complete search history.

(56) References Cited

U.S. PATENT DOCUMENTS

| | | | | |
|---|---|---|---|---|
| 5,990,790 | A * | 11/1999 | Lusareta | A47G 23/0306 206/459.1 |
| 6,902,304 | B2 * | 6/2005 | Yang | B65D 39/0094 362/101 |
| 8,376,161 | B2 * | 2/2013 | Golden | B65D 51/28 215/228 |
| 8,414,163 | B2 * | 4/2013 | Hashimoto | F21V 3/00 362/368 |
| 8,558,715 | B2 * | 10/2013 | Lien | B65D 25/00 340/691.1 |
| 8,960,466 | B2 * | 2/2015 | Golden | B65D 39/00 215/228 |
| 9,975,675 | B1 * | 5/2018 | Kuo | B65D 39/16 |
| 2016/0053969 | A1 * | 2/2016 | Wang | A47G 33/08 362/311.13 |

* cited by examiner

*Primary Examiner* — Kareen K Thomas
(74) *Attorney, Agent, or Firm* — Leong C. Lei

(57) ABSTRACT

An illuminated bottle stopper mainly includes a lighting, plug body and light transmission tube, where the lighting is a light transmission decoration of a preset shape with an optoelectronic unit configured on the bottom thereof, the plug body is tapered and assembled on the bottom of the base, a passage is longitudinally configured inside the plug body, one end of the light transmission tube is in connection with the passage of the plug body bottom, and a light source is configured to illuminate the light transmission tube, thereby allowing light to be scattered inside and outside a bottle when the plug body is inserted in the mouth of the bottle.

6 Claims, 5 Drawing Sheets

ILLUMINATED BOTTLE STOPPER

TECHNICAL FIELD OF THE INVENTION

The present invention relates to a bottle stopper, and more particularly to an illuminated bottle stopper.

DESCRIPTION OF THE PRIOR ART

A stopper or a disposable cap that is generally incorporated into a wine bottle is damaged after opened. Therefore, a user needs to shield the bottle mouth with another article to prevent air to enter the inside of the bottle and further to achieve long term storage; most customers will use an item at their fingertips such as handi-wrap or plastic bag or a market available bottle stopper to shield the bottle mouth.

Some current bottle stoppers are designed to have decorations of different shapes on the tops thereof besides can be used to seal bottles tightly, hoping to improve the sense of design. However, for consumers and markets seeking new and changing, it is still hoped that there are more different designs and structures on stoppers to enhance the desire to buy.

SUMMARY OF THE INVENTION

To improve aesthetics and competitiveness of a bottle stopper, the present invention is proposed.

The main object of the present invention is to provide an illuminated bottle stopper, adapted to improve aesthetics and competitiveness of a bottle stopper.

To achieve the above object, the present invention proposes an illuminated bottle stopper, including: a lighting, including a light transmission decoration of a preset shape and a base in connection with a bottom of the decoration, an optoelectronic unit configured inside the base and having an circuit board and light emitting element, the light emitting element correspondingly configured below the decoration, and a bottom of the base configured with a power supply room, allowing a battery to be accepted to be in electric connection with the optoelectronic unit; a plug body, tapered from top to bottom and assembled on a bottom of the base, an outer edge of the plug body annularly configured with a soft tough element, and an inside of thereof longitudinally configured with a passage in communication with the power supply room; and a light transmission tube, one end thereof in connection with the passage on bottom of the plug body, a light source configured to illuminated the light transmission tube, and the light source in electric connection with the power supply room.

With the above structures, the lighting is adapted to emit light, and the light transmission tube guide and scatter light from the light source to improve the competitiveness of the bottle stopper when the present invention is inserted in the mouth of the bottle.

DETAILED DESCRIPTION OF THE PREFERRED EMBODIMENTS

Figure 1:
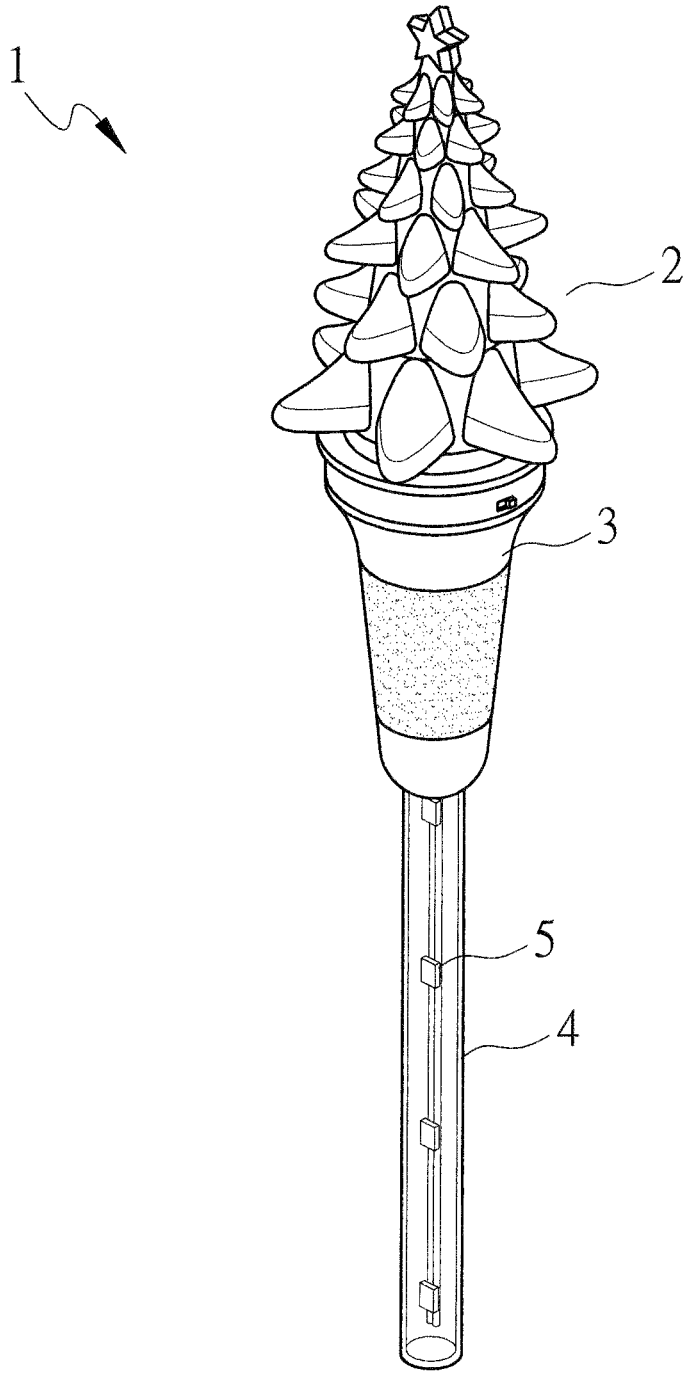
FIG. 1 is a perspective view of the present invention.
Figure 2:
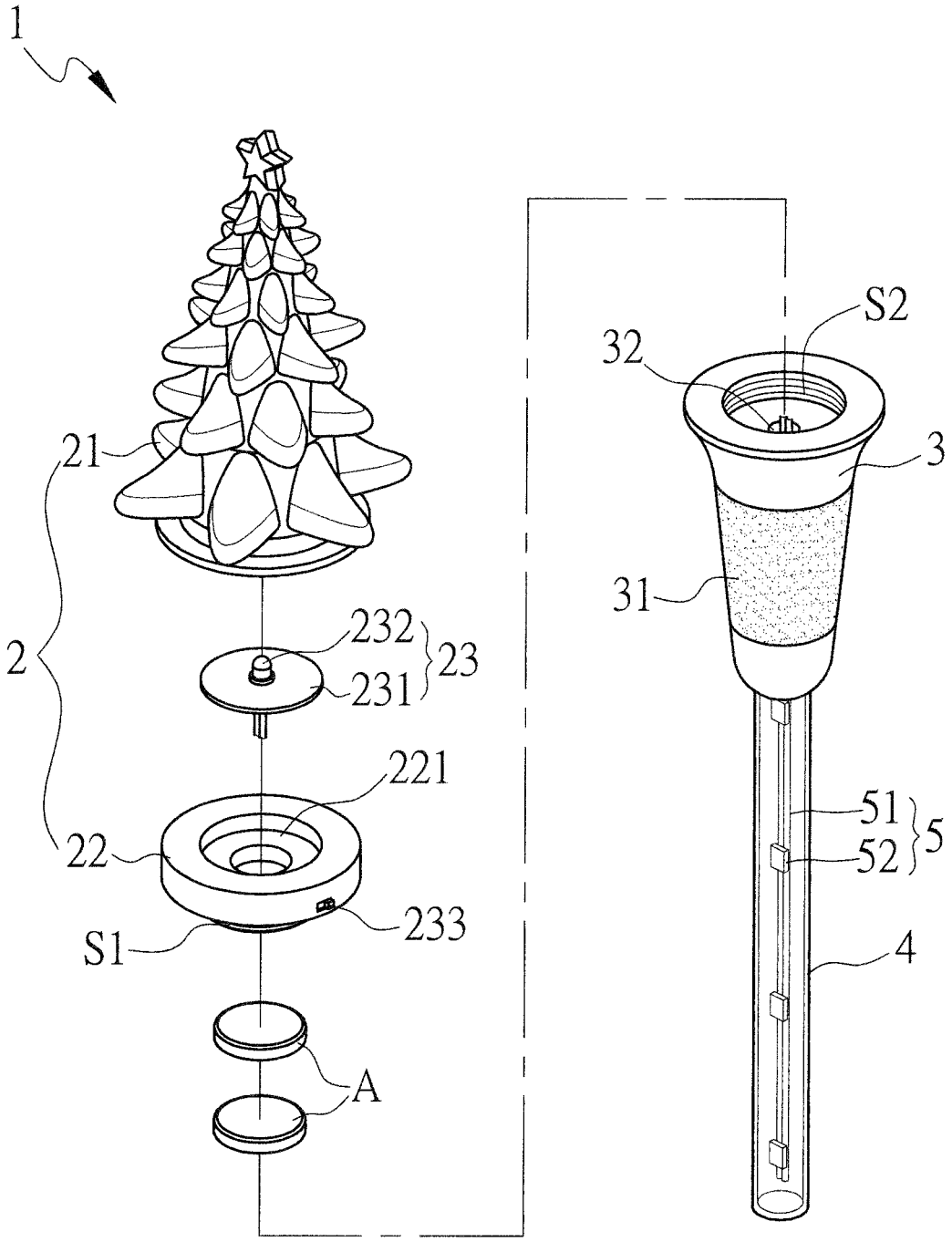
FIG. 2 is an exploded view of the present invention.
Figure 3:
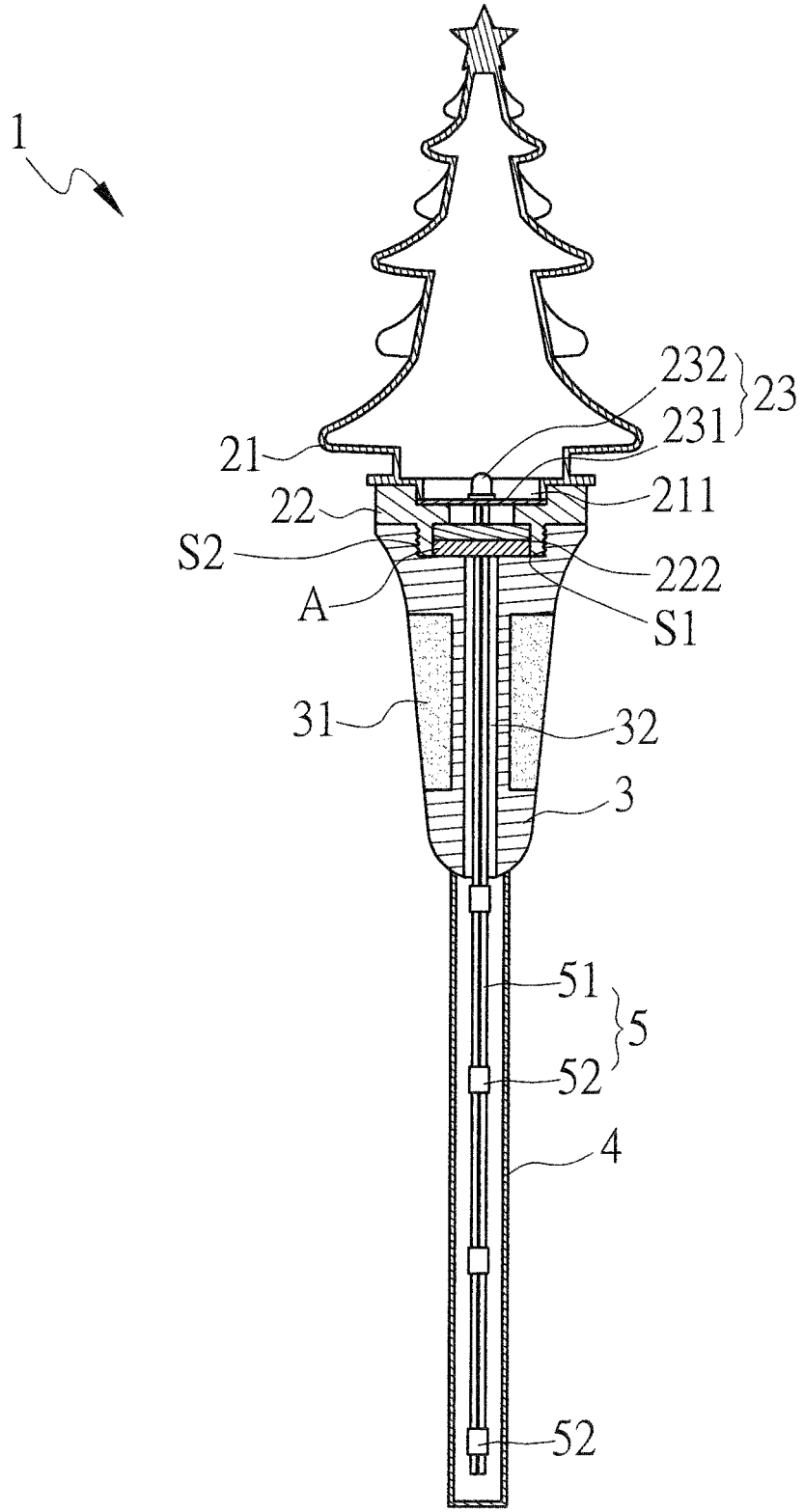
FIG. 3 is a cross-sectional view of the present invention.

Referring to FIGS. 1 to 3, an illuminated bottle stopper 1 of the present invention, in a preferred embodiment, mainly includes a lighting 2, plug body 3 and a light transmission tube 4, where the lighting 2 includes a light transparent decoration 21 of a preset shape and base 22 in connection with the bottom of the decoration 21, where the decoration 21 is a shell with a downward opening 211. The present invention takes a Christmas tree as a shape example, but it is not used to limit its appearance structure; the decoration 21 may also be a solid light-transmissible body. The base 22 is configured with a groove 221 with a upward opening and a power supply room 222 in communication with the groove 221, and the groove 221 is accommodated with an optoelectronic unit 23 having at least one circuit board 231 and a light emitting element 232, where the light emitting element 232 is correspondingly configured below the decoration 21, and the power supply room 222 is adapted to accept a battery a and is in electric connection with the optoelectronic unit 23.

Furthermore, the optoelectronic unit 23 further has a switch 233 mainly used to switch on and off the battery a, and the switch 233 is a manual switch, light switch, touch switch or rotary switch; the present invention is described with the manual switch.

The plug body 3 is tapered from top to bottom and is assembled below the base 22, where the outer edge of the plug body 3 is annularly configured with a soft tough element 31, which may be made of rubber, silicone or cork, where the inside of the plug body 3 is longitudinally configured with a passage 32 in communication with the power supply room 222. In the embodiment, The outer edge of the power supply room 222 is configured with external threads s1, and the top of the plug body 3 is correspondingly configured with internal threads s2 in engagement with the external threads s1, but the present invention does not limit the assembly manner of the base 22 and plug body 3, and any manner allowing the plug body 3 to be detachably coupled to the bottom the base 22 is dropped in the scope of the present invention.

In the embodiment, the light transmission tube 4 is a hollow tube, one end of the light transmission tube 4 is sealed, and another end thereof is open and in connection with the mouth of the passage 32 on the bottom of the plug body 3; the joint of the light transmission tube 4 and the plug body 3 is in a closed state, and a light source 5 is configured inside the light transmission tube 4 and in electric connection with the power supply rom 222, where the light source 5, in the embodiment, is in the form of a light string and includes an electric line 51 extended throughout the passage 32 of the plug body 3 to be in electric connection with the power supply room 222. Furthermore, a plurality of spaced light emitting elements 52 are configured on the electric line 51, where each light emitting element may be a LED or light bulb.

Figure 4:
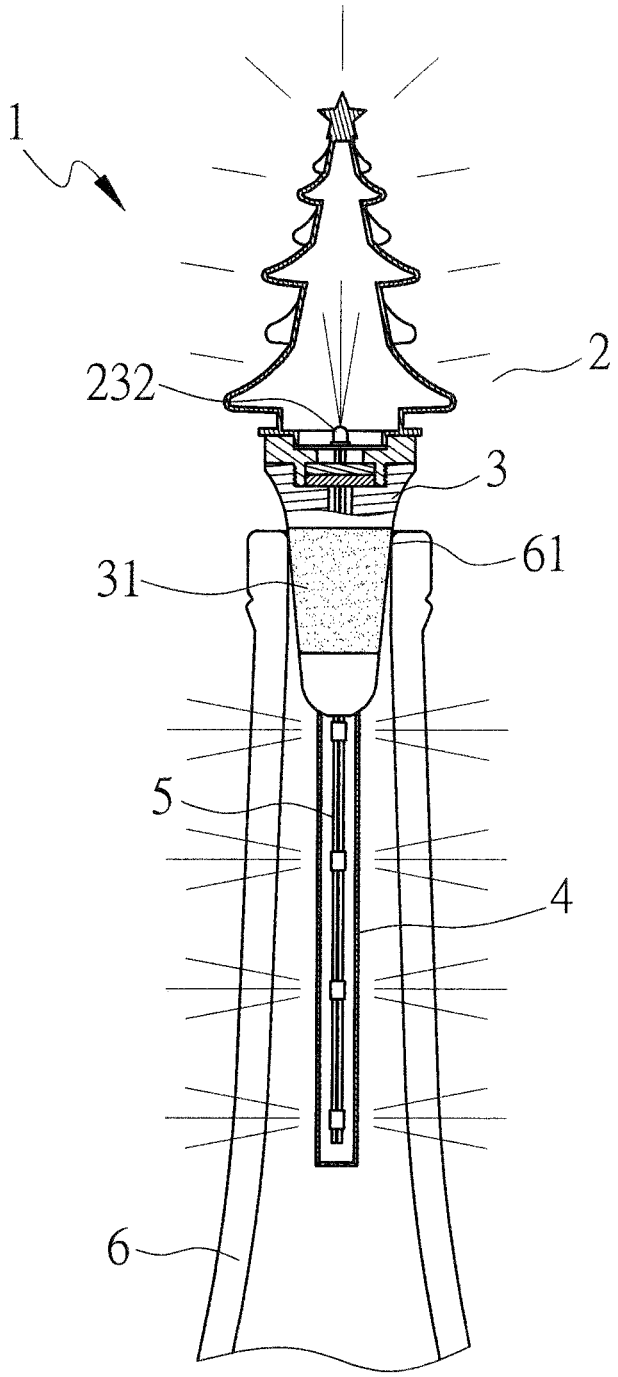
FIG. 4 is a schematic view of the present invention in a use stat.

Further referring to FIG. 4, when the present invention is inserted in a bottle 6, the soft tough element 31 configured on the outer edge of the plug body 3 is used to seal a bottle mouth 61 of the bottle 6, and the light transmission tube 4 is extended in the bottle 6, with the lighting 2 being formed into a decoration above the bottle mouth 61. When the switch 233 is switched on, light is emitted from the light emitting element 232 of the optoelectronic unit 23 to allow the entire lighting 2 to illuminate on the bottle mouth 61. In addition, the light source 5 inside the light transmission tube 4 is brightly lit in the bottle 6, and the light is refracted and reflected by the fluid inside the bottle 6, allowing the bottle 6 to have a dazzling visual effect. Whereby, the present invention further allows the bottle stopper 1 to become a lighting to increase the aesthetics and competitiveness of the product besides has the effect of sealing the bottle mouth 61.

Figure 5:
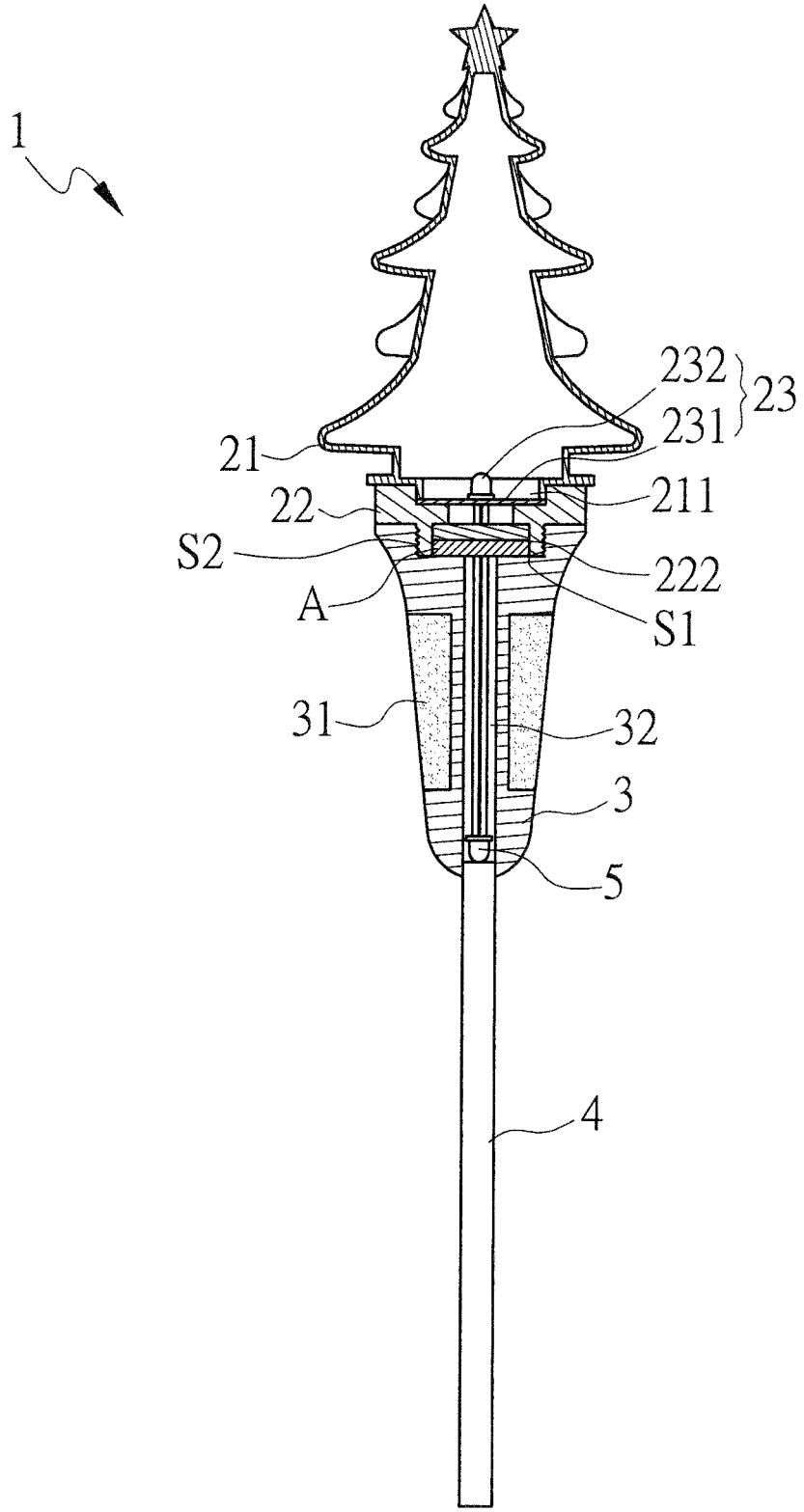
FIG. 5 is a cross-sectional view of a preferred embodiment of the present invention.

Finally, referring to FIG. 5, which shows a variant embodiment of the present invention, the present embodiment is almost similar to the above embodiment except the light transmission tube 4 is a solid tube in the present embodiment, where one end of the light transmission tube 4 is in connection with the mouth of the passage 32 on the bottom of the plug body 3, and the light source 5 is an LED or light bulb; the light source is configured inside the passage 32 and the light emitting side of the light source 5 is abutted against one end of the light transmission tube 4. Whereby, light emitted from the light source 5 is guided to the entire light transmission tube 4, allowing the bottle 6 to have a different visual effect.

I claim:

1. An illuminated bottle stopper, comprising:

a lighting, comprising a light transmission decoration of a preset shape and a base in connection with a bottom of said decoration, an optoelectronic unit configured inside said base and having an circuit board and light emitting element, said light emitting element correspondingly configured below said decoration, and a bottom of said base configured with a power supply room, allowing a battery to be accepted to be in electric connection with said optoelectronic unit;

a plug body, tapered from top to bottom and assembled on a bottom of said base, an outer edge of said plug body annularly configured with a soft tough element, and an inside of thereof longitudinally configured with a passage in communication with said power supply room; and a light transmission tube, one end thereof in connection with said passage on bottom of said plug body, a light source configured to illuminated said light transmission tube, and said light source in electric connection with said power supply room.

2. The stopper according to claim 1, wherein said optoelectronic unit further has a switch adapted to switch on and off the power of said battery.

3. The stopper according to claim 1, wherein said decoration is formed into a shell with a downward opening, said base has a groove with a upward opening, and said optoelectronic unit is accommodated in said groove.

4. The stopper according to claim 1, wherein an outer edge of said power supply room is configured with external threads, and said plug body internal threads in engagement with said external threads.

5. The stopper according to claim 1, wherein said light transmission tube is a solid tube, and said light source is accommodated in said passage.

6. The stopper according to claim 1, wherein said light transmission tube is a hollow tube, one end thereof in connection with said passage is open, and another end thereof is sealed, when said light source being a light string and configured inside said light transmission tube.

* * * * *